US010335661B2

(12) United States Patent
Liu et al.

(10) Patent No.: US 10,335,661 B2
(45) Date of Patent: Jul. 2, 2019

(54) BREASTSTROKE LEG STRENGTH TRAINING DEVICE

(71) Applicant: SHANDONG NORMAL UNIVERSITY, Jinan, Shandong (CN)

(72) Inventors: Xiaoyi Liu, Jinan (CN); Qingguo Lin, Jinan (CN)

(73) Assignee: SHANDONG NORMAL UNIVERSITY, Jinan (CN)

( * ) Notice: Subject to any disclaimer, the term of this patent is extended or adjusted under 35 U.S.C. 154(b) by 81 days.

(21) Appl. No.: 15/571,008

(22) PCT Filed: Sep. 9, 2016

(86) PCT No.: PCT/CN2016/098528
§ 371 (c)(1),
(2) Date: Oct. 31, 2017

(87) PCT Pub. No.: WO2017/050138
PCT Pub. Date: Mar. 30, 2017

(65) Prior Publication Data

US 2018/0161655 A1 Jun. 14, 2018

(30) Foreign Application Priority Data

Sep. 24, 2015 (CN) ..... 2015 1 0617639

(51) Int. Cl.
*A63B 69/10* (2006.01)
*A63B 21/055* (2006.01)

(52) U.S. Cl.
CPC ..... *A63B 69/10* (2013.01); *A63B 21/0552* (2013.01)

(58) Field of Classification Search
CPC ..... A63B 69/10; A63B 69/14
See application file for complete search history.

(56) References Cited

U.S. PATENT DOCUMENTS 896,114 A * 8/1908 Jacobson ..... A61H 1/0218 606/241
964,886 A * 7/1910 Sickels ..... A63B 69/10 441/55

(Continued)

FOREIGN PATENT DOCUMENTS

CN 2160432 Y 4/1994
CN 2455300 Y 10/2001

(Continued)

OTHER PUBLICATIONS

Dec. 20, 2016 International Search Report issued in International Patent Application No. PCT/CN2016/098528.

*Primary Examiner* — Garrett K Atkinson
(74) *Attorney, Agent, or Firm* — Oliff PLC

(57) ABSTRACT

A breaststroke leg strength training device, including a lower panel, and a prostrate platform connected with the panel through an elastic band and located below one side of the panel; a slit consistent with a breaststroke leg movement trajectory is formed in the panel, and an elastic band attachment column is respectively arranged at positions on both sides of the slit and on the panel; two foot pedal middle shafts are arranged in the slit and extend to the lower side of the panel; and the elastic band is connected with the attachment columns through a fixed beam fixed to the platform and the two foot pedal middle shafts. The device has a smart structural design, a trainer can comprehensively train all the muscle groups involved in the breaststroke leg actions in a continuous and efficient manner, and the breaststroke leg actions of the trainer can be specified and corrected.

10 Claims, 4 Drawing Sheets

(56) References Cited

U.S. PATENT DOCUMENTS 1,966,448 A * 7/1934 Kabisius ..... A63B 69/10 165/181
1,990,124 A * 2/1935 Kabisius ..... A63B 69/10 482/56
2,109,775 A * 3/1938 Hudson ..... A63B 21/154 434/254
3,810,614 A * 5/1974 Hessburg ..... A63B 17/00 482/56
4,227,273 A * 10/1980 Lucciola ..... A63B 69/14 434/254
4,422,634 A * 12/1983 Hopkins ..... A63B 69/10 482/56
4,434,981 A * 3/1984 Norton ..... A63B 21/00072 482/51
4,674,740 A * 6/1987 Iams ..... A63B 69/10 482/111
4,872,668 A * 10/1989 McGillis ..... A63B 21/0083 482/113
4,886,050 A * 12/1989 Iams ..... A63B 23/0355 601/23
4,986,261 A * 1/1991 Iams ..... A61H 1/0218 482/51
5,354,251 A * 10/1994 Sleamaker ..... A63B 21/156 482/142
5,366,426 A * 11/1994 Glavin ..... A63B 23/03516 482/126
5,376,060 A * 12/1994 Murray ..... A63B 21/153 434/254
5,451,194 A * 9/1995 Harrigan ..... A63B 21/0552 482/124
5,707,320 A 1/1998 Yu
6,764,431 B2 * 7/2004 Yoss ..... A63B 69/10 434/254
7,402,127 B2 * 7/2008 Rizzo ..... A63B 21/00185 434/253
7,601,103 B2 * 10/2009 Chen ..... A63B 69/10 434/254
9,675,861 B2 * 6/2017 Barnes ..... A63B 21/00185
2003/0004036 A1 * 1/2003 Yoss ..... A63B 69/10 482/51
2014/0005004 A1 * 1/2014 Hall, Sr. ..... A63B 69/10 482/55
2014/0011645 A1 * 1/2014 Johnson ..... A63B 21/0552 482/121
2014/0315171 A1 * 10/2014 Tsai ..... A63B 69/10 434/254
2015/0328520 A1 * 11/2015 Barnes ..... A63B 21/00185 482/56

FOREIGN PATENT DOCUMENTS

CN 102489015 A 6/2012
CN 203355243 U 12/2013
CN 203507464 U 4/2014
CN 105107180 A 12/2015
CN 205042069 U 2/2016
DE 2241797 B2 9/1976
RU 2034590 C1 5/1995

* cited by examiner

BREASTSTROKE LEG STRENGTH TRAINING DEVICE

FIELD OF THE INVENTION

The present invention relates to a breaststroke leg strength training device, and belongs to the field of sport equipment.

BACKGROUND OF THE INVENTION

Breaststroke is one of swimming events, it is very important to exercise the leg strength, and the technical methods of breaststroke leg actions are as follows: Drawing back the legs: no matter the distance between the double knees in the process of drawing back the legs is narrow or wide, the principle of drawing back the legs is that the legs should be drawn back to positions most conducive to kicking on the premise of reducing the head resistance as much as possible, the inner sides of shanks and the inner sides of soles should face to water after the soles are overturned, in this way, the water push area can be the maximum, and then the maximum kicking (leg swinging) efficiency can be realized. In order to achieve such a technical state, in the process of drawing back the legs, the distance between the double knees cannot be too large, and when the process of drawing back the legs is completed and the soles are overturned, the distance between the double knees must be smaller than the distance between double ankles. If the distance between the double knees is too large, the beneficial states for water on the inner sides of the shanks and the inner sides of the soles are hard to form as shown in FIG. 6, and when the process of drawing back the legs is ended and when the soles are overturned, the distance between the double knees must be smaller than the distance between double ankles. The action of drawing back the legs must be fast: the action of drawing back the legs generates resistance, so the action of drawing back the legs must be accomplished at a higher speed, but is relatively slower than the kicking (leg swinging) action. In general, after the hands are taken back, and when the double hands touch, the action of drawing back the legs is started, and all actions of drawing back the legs and swinging the legs are accomplished within the rest short hand stretching time interval.

Phase when the action of drawing back the legs is accomplished: when the action of drawing back the legs is accomplished, the double ankles are outward, the distance between the double knees must be smaller than the distance between the double ankles, the sole overturning action has been started at this time, the included angles between the thighs and the abdomen are about 120 degrees, the shanks are folded to the thighs as much as possible, the feet firmly lean against the haunch to store force (as shown in FIG. 7 and FIG. 8). In FIG. 7 and FIG. 8, the included angles between the thighs and the abdomen are about 120 degrees, and the feet firmly lean against the haunch.

Overturning the soles: the kicking effect of breaststroke greatly depends on the technology of overturning the soles. When the action of drawing back the legs is about to end, the double feet start to perform outward overturning actions: the double feet are rotated forward, the double heels are externally separated as much as possible, toes face to the left and right sides, the knee joints are slightly rotated inward, and finally the soles and the inner sides of the shanks form the most conducive (backward) water push plane (FIG. 10).

The leg swinging (kicking) action must be started when the outward overturning action of the feet is not accomplished in place, the final outward overturning water push posture is accomplished short after the action of swinging the legs is started, and the action of swinging the legs cannot be started after the water push posture of the sole overturning action is accomplished.

Swinging the legs: the leg swinging direction: the leg swinging (kicking) direction of modern breaststroke is straight down to the back rather than horizontally swinging the legs toward the two sides. The soles and the inner sides of the shanks form the maximum water push planes and directly kick to the bottom of a pool so as to generate the maximum power. In such leg swinging mode, after the leg swinging is accomplished and the double legs are merged, the haunch and the legs rise by means of the bounce to be parallel to the water level, thereby reducing the head resistance. With respect of the action of horizontally swinging the legs toward the two sides, the effect is worse, greater head resistance is generated, and the haunch and the legs are liable to sink after the actions are accomplished.

Leg swinging route: looked down vertically, the movement trajectories of the double feet are two symmetrical curves with very small radian and are close to straight lines (FIG. 9) in the leg swinging process, and the routes of swinging the legs toward the two sides look like triangles.

At present, the training of breaststroke leg strength is usually training of muscle groups involved in breaststroke leg actions, for example, haunch (gluteus maximus, gluteus medius and gluteus round muscles) and leg muscles (quadriceps femoris, biceps femoris muscle, musculus gastrocnemius and the like) are developed by squatting with weight, leapfrog, jumping steps and other auxiliary training methods, the training of"sartorius" on the inner thighs that is important in a "water clamping" action process should be singly trained by using heavy punches or elastic bands, and thus the training steps are troublesome.

SUMMARY OF THE INVENTION

In order to overcome the shortcomings of the prior art, the present invention provides a breaststroke leg strength training device.

The present invention adopts the following technical solution:

A breaststroke leg strength training device includes a lower panel, and a prostrate platform that is connected with the lower panel through an elastic band and is located below one side of the lower panel, and a fixed beam is arranged on the prostrate platform;

a slit consistent with a breaststroke leg movement trajectory is formed in the lower panel; an elastic band attachment column is respectively arranged at positions on both sides of the slit and on the lower panel;

two foot pedal middle shafts moving back and forth in the slit are arranged in the slit of the lower panel and extend to the lower side of the lower panel; and the elastic band is connected with the elastic band attachment columns through a fixed beam fixed to the prostrate platform and the two foot pedal middle shafts, and when the foot pedal middle shafts move back and forth in the slit, the elastic band generates longitudinal and transverse tension.

Preferably, an upper panel parallel to the lower panel and with a set distance from the lower panel is arranged on the lower panel, the upper panel is provided with a slit corresponding to the slit on the lower panel, and the upper parts of the two foot pedal middle shafts extend to the upper side of the upper panel. The upper panel can better ensure that the two foot pedal middle shafts move in the slit more stably.

Preferably, the prostrate platform is composed of a horizontal panel and an inclined panel, the two planes form an angle of 120-130 degrees, during training, a trunk of a trainer is located on the horizontal panel, thighs of the trainer are located on the inclined panel, and the trunk and the thighs of the trainer form an angle of 120-130 degrees so as to specify the angles when the trainer draws back the legs.

Preferably, rolling groove pulleys matched with the lower panel are arranged on the foot pedal middle shafts, the rolling groove pulleys and the foot pedal middle shafts are coaxial and are firmly fixed, the grooves (capable of clamping the lower panel) of the rolling groove pulleys are matched with the arc-shaped slit in widths and depths, the foot pedal middle shafts are fixed to the lower panel vertically, and the foot pedal middle shafts can move back and forth in the slit under the action of external force by means of the fixing and rolling functions of the rolling groove pulleys.

More preferably, rolling groove pulleys matched with the upper and lower panels are respectively arranged on upper and lower parts of the foot pedal middle shafts, the pulleys and the foot pedal middle shafts are coaxial and are firmly fixed, the rolling groove pulleys vertically fix the foot pedal middle shafts between the upper panel and the lower panel, and the foot pedal middle shafts can move back and forth in the slit under the action of external force by means of the fixing and rolling functions of the rolling groove pulleys.

Preferably, a plurality of stop blocks are arranged on both sides of the slit on the lower panel, movable strip steels are further arranged on both sides of the slit on the lower panel, the stop blocks are matched with the strip steels for use of adjusting the starting positions of the foot pedal middle shafts, the placement positions of the strip steels in the stop blocks are randomly changed, and the foot pedal middle shafts are clamped on the outer side of the slit so as to meet the use of trainers with different shoulder widths and body lengths.

Preferably, the lower panel is supported by struts, but not limited to the struts.

Preferably, foot pedals are arranged at the bottoms of the foot pedal middle shafts, and the trainer steps the feet on the foot pedals to train breaststroke leg actions more comfortably.

Preferably, a cross beam connected with the fixed beam is arranged on the upper panel for longitudinally reinforcing the fixed beam so as to make the fixed beam be more stable.

Preferably, the prostrate platform is supported by a telescopic bracket for adjusting the height of the prostrate platform.

Preferably, the distance between the upper panel and the lower panel is adjustable.

Preferably, pores through which the elastic band penetrates are formed in the fixed beam and the two foot pedal middle shafts for limiting the position of the elastic band.

When the trainer trains the breaststroke leg strength by using the breaststroke leg strength training device provided by the present invention:

(1) the trainer steps the bottoms of the foot pedal middle shafts, and the distance between the two foot pedal middle shafts is larger than the shoulder widths of the trainer (standard technical requirements: when the action of drawing back the legs is ended, the inner sides of double knees of the trainer keep consistency with the outer edges of the shoulders of the trainer);

(2) the height of the prostrate platform and the relative position with the lower panel are repeatedly adjusted to meet the requirements that the heels approach to the haunch when the trainer accomplishes the action of drawing back the legs;

(3) the trainer prostrates on the prostrate platform, grabs the fixed beam on the front part of the prostrate platform by double hands and performs the action of "drawing back, overturning, kicking and clamping) of breaststroke legs;

(4) the trainer draws back the thighs, and the angles between the planes where the thighs and the trunk of the trainer are located are 120-130 degrees;

(5) when the double feet are drawn back leaning against the bottoms of the foot pedal middle shafts, and when the heels approach to the haunch, the trainer performs the actions of folding the tiptoes and overturning the feet;

(6) after the feet are overturned, the inner sides of arches are aligned to the bottoms of the foot pedal middle shafts;

(7) the actions of kicking and water clamping are carried out in directions where the inner sides of the arches are aligned to the shanks (at this time, the foot pedal middle shafts move backward along the slit);

(8) under the tension of the longitudinal part of the elastic band, certain burden (the magnitude of the burden is changed according to the magnitude of the force of the trainer and the training burden requirements by increasing and decreasing the elastic bands) is brought to the muscle groups necessary for the backward "leg kicking" of the trainer, in order to develop special force;

(9) the trainer continues to kick the legs backward, when the two foot pedal middle shafts are stepped to the last half stroke (when the "water clamping" action is carried out) by the feet, the tension of the longitudinal elastic band still exists, and the tension is "born by the panel" with the movement of the foot pedal middle shafts toward the middle along the slit;

(10) in linkage with the above leg kicking action, the "water clamping" action is started, the horizontal part of the elastic band starts to act to generate an outward counterforce so as to bring burden (the magnitude of the burden can also be changed according to the magnitude of the force of the trainer and the training burden requirements by increasing and decreasing the elastic bands) to the muscle groups necessary for the "water clamping" action of the trainer to train the force of the muscle groups necessary for the "water clamping" action;

(11) the water clamping action is accomplished (at this time, the two foot pedal middle shafts are located at the most tail end of the slit), the trainer clamps the double legs and slightly stretches the tiptoes toward the lower side, so that the double feet of the trainer separately move downward along the foot pedals, the vertical positions of the double feet have moved to the most bottoms (being separate from the foot pedal middle shafts) of the foot pedal middle shafts when the foot stretching action is accomplished, and the foot pedal middle shafts are released, and

(12) the trainer carries out the next action of "drawing back the legs", at this time, the "released" foot pedal middle shafts will be drawn back (quickly returning to the front end of the slit) under the action of the traction forces of the horizontal elastic band and the longitudinal elastic band.

One flow is terminated, circulation is carried out, and convenient body training is carried out in accordance with the requirements of the number of groups, the number in each group, and the burden changes in each group required by a training plan.

The present invention has a smart structural design, the trainer can comprehensively train all the muscles involved in the breaststroke leg actions by the present invention in a continuous and efficient manner, and the breaststroke leg actions of the trainer can be specified and corrected, so that the training steps of the breaststroke leg strength are simplified and efficient.

Reference signs: 1. elastic band, 2. prostrate platform, 2-1. horizontal panel, 2-2. inclined panel, 3. upper panel, 4. lower panel, 5. slit, 6. elastic band attachment column, 7. foot pedal middle shaft, 8. foot pedal, 9. rolling groove pulley, 10. stop block, 11. strip steel, 12. strut, 13. fixed beam, 14. cross beam.

DETAILED DESCRIPTION OF THE EMBODIMENTS

The present invention will be further illustrated below in combination with the drawings and embodiments.

Embodiment 1

Figure 1:
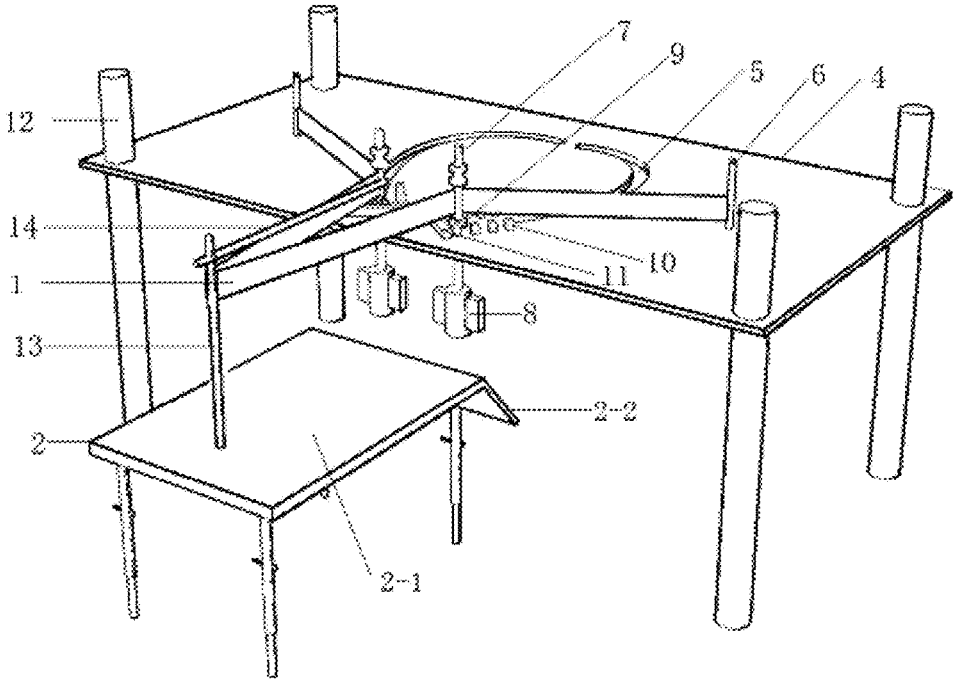
FIG. 1 is a perspective of the present invention.

As shown in FIG. 1, a breaststroke leg strength training device includes a lower panel 4, and a prostrate platform 2 that is connected with the lower panel 4 through an elastic band 1 and is located below one side of the lower panel 4, and a trainer prostrates on the prostrate platform 2 during the training.

Figure 3:
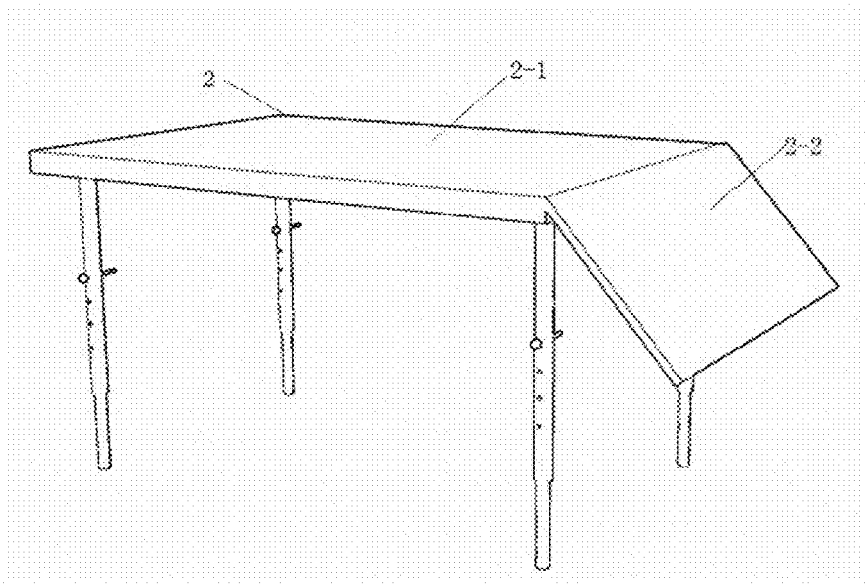
FIG. 3 is a structural schematic diagram of a prostrate platform of the present invention.

As shown in FIG. 3, the prostrate platform 2 is composed of a horizontal panel 2-1 and an inclined panel 2-2, the inclined panel 2-2 is close to one side of the lower panel 4, the two planes where the horizontal panel 2-1 and the inclined panel 2-2 are located form an angle of 120 degrees, a fixed beam 13 is arranged on the horizontal panel 2-1, the trainer prostrates on the prostrate platform 2 during the training and grabs the fixed beam 13 by both hands, the trunk of the trainer is located on the horizontal panel 2-1, thighs of the trainer are located on the inclined panel 2-2, and the planes where the trunk and the thighs of the trainer are located form an angle of 120 degrees so as to specify the angles of drawing back the thighs of the trainer.

The lower panel 4 is made of a steel material.

An arc-shaped slit 5 consistent with movement trajectories of breaststroke leg actions is formed in the lower panel 4, and an elastic band attachment column 6 is respectively arranged at positions on both sides of the arc-shaped slit 5 and on the lower panel 4; and two foot pedal middle shafts 7 moving back and forth in the arc-shaped slit 5 are arranged in the arc-shaped slit 5 of the lower panel 4 and extend to the lower side of the lower panel 4; and foot pedals 8 are arranged at the bottoms of the foot pedal middle shafts 7, and the trainer steps the feet on the foot pedals 8 to train breaststroke leg actions more comfortably. The legs of the trainer can better fit to the foot pedals after prostration.

Figure 5:
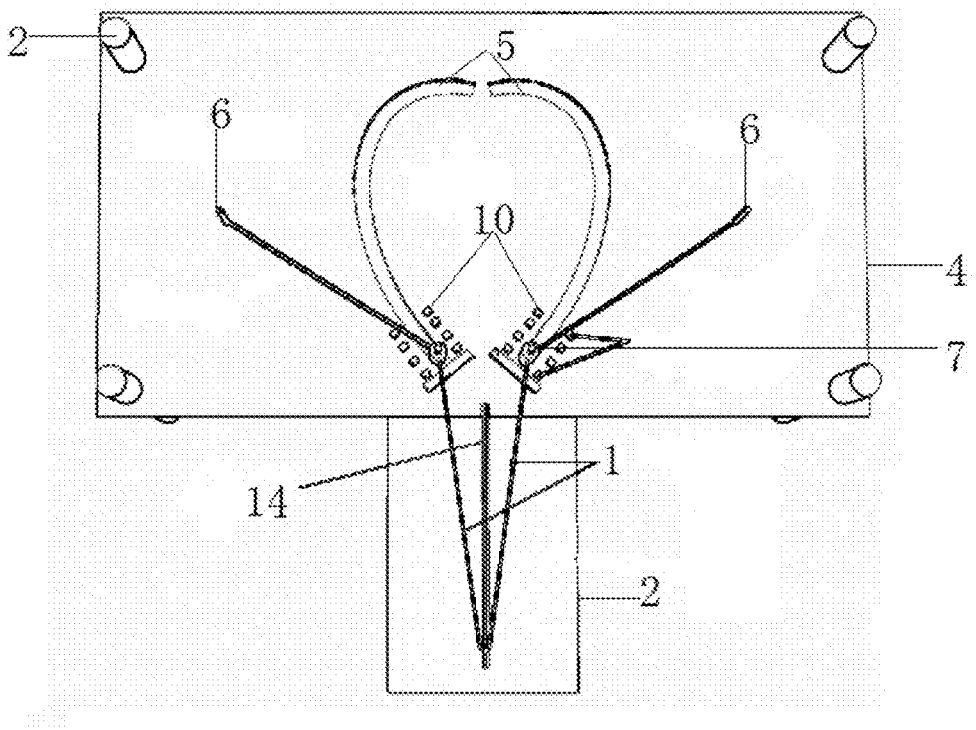
FIG. 5 is a schematic diagram of an overlooking structure of the present invention.
Figure 6:
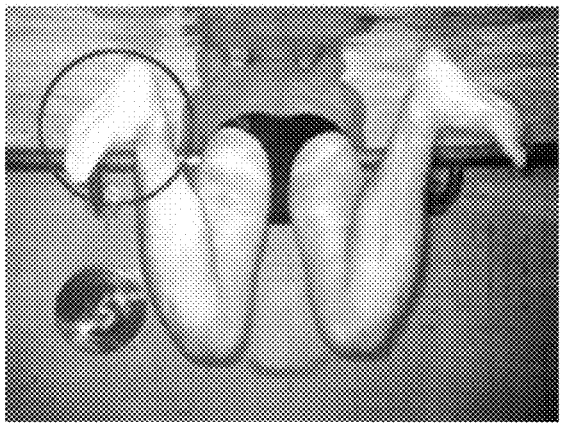
FIG. 6 is a schematic diagram of leg postures of a trainer.

As shown in FIG. 5, rolling groove pulleys 9 matched with the lower panel 4 are arranged on the foot pedal middle shafts 7, rolling groove pulleys 9 and the foot pedal middle shafts 7 are coaxial and are firmly fixed, the grooves (capable of clamping the lower panel 4), widths and depths of the rolling groove pulleys 9 are matched with the arc-shaped slit 5, the foot pedal middle shafts 7 are fixed to the lower panel 4 vertically, and the foot pedal middle shafts 7 can move back and forth in the arc-shaped slit 5 under the action of external force by means of the fixing and rolling functions of the rolling groove pulleys 9.

Figure 4:
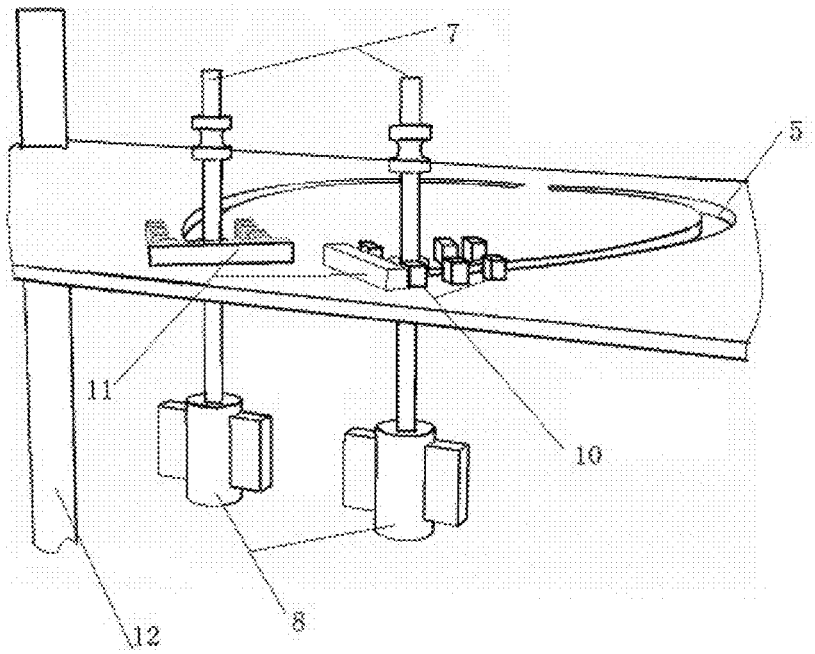
FIG. 4 is a schematic diagram of a local structure of the present invention.

As shown in FIG. 4, a plurality of stop blocks 10 and two movable strip steels 11 are arranged on both sides of a front end (close to one side of the inclined panel 2-2) of the arc-shaped slit 5 on the lower panel 4, the stop blocks 10 are matched with the strip steels 11 for use for adjusting the starting positions of the foot pedal middle shafts 7, the placement positions of the strip steels 11 in the stop blocks 10 are randomly changed, and the foot pedal middle shafts 7 are clamped on the outer side of the arc-shaped slit 5 so as to meet the use of trainers with different shoulder widths and body lengths.

Pores are formed in the fixed beam 13 and the two foot pedal middle shafts 7, the elastic band 1 is connected with the elastic band attachment column 6 through the fixed beam and the pores of the two foot pedal middle shafts, and when the foot pedal middle shafts 7 move back and forth in the arc-shaped slit 5, the elastic band 1 generates longitudinal and horizontal tension. The foregoing description is merely a preferred manner, when the fixed beam 13 and the foot pedal middle shafts 7 are not provided with the pores through which the elastic band 1 penetrates, as long as the fixed beam 13 and the two foot pedal middle shafts 7 are rounded by the elastic band 1, the elastic band 1 can generate the longitudinal and horizontal tension.

The lower panel 4 is supported by struts 12, but not limited to the struts 12.

The prostrate platform 2 is supported by a telescopic bracket for adjusting the height of the prostrate platform 2.

Embodiment 2

Figure 2:
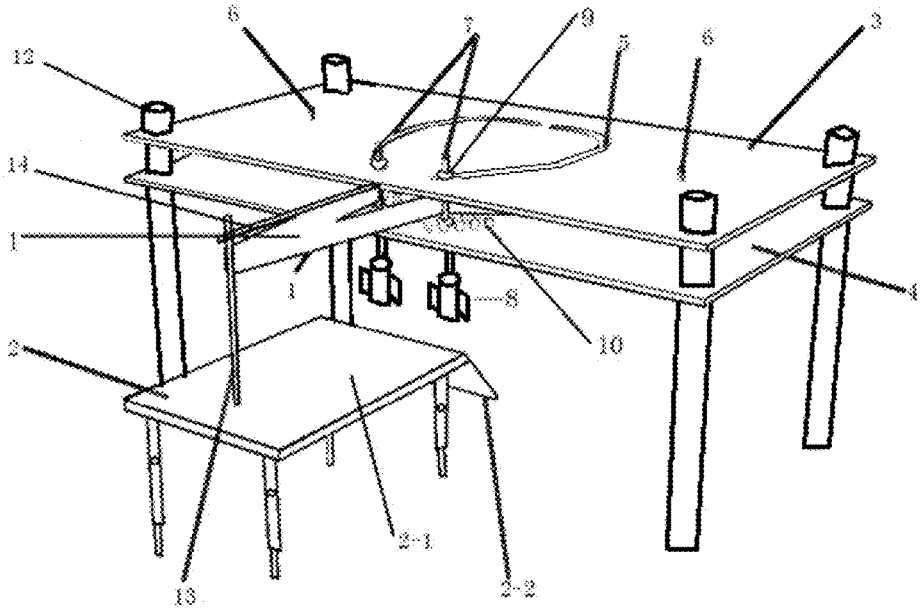
FIG. 2 is a perspective with a double-layer panel structure of the present invention.

As shown in FIG. 1 and FIG. 2, a breaststroke leg strength training device includes a double-layer panel, and a prostrate platform 2 that is connected with the double-layer panel through an elastic band 1 and is located below one side of the double-layer panel, and a trainer prostrates on the prostrate platform 2 during the training.

As shown in FIG. 3, the prostrate platform 2 is composed of a horizontal panel 2-1 and an inclined panel 2-2, the inclined panel 2-2 is close to one side of the double-layer panel, the two planes where the horizontal panel 2-1 and the inclined panel 2-2 are located form an angle of 120 degrees, a fixed beam 13 is arranged on the horizontal panel 2-1, the trainer prostrates on the prostrate platform 2 during the training and grabs the fixed beam 13 by both hands, the trunk of the trainer is located on the horizontal panel 2-1, thighs of the trainer are located on the inclined panel 2-2, and the planes where the trunk and the thighs of the trainer are located form an angle of 120 degrees so as to specify the angles of drawing back the thighs of the trainer.

The double-layer panel is composed of an upper panel 3 and a lower panel 4, which are parallel to the horizontal plane and are arranged according to a set distance, and the upper panel 3 and the lower panel 4 are made of a steel material;

arc-shaped slits 5 consistent with movement trajectories of breaststroke leg actions are formed in the upper panel 3 and the lower panel 4, and the arc-shaped slits 5 in the upper panel 3 and the lower panel 4 correspond to each other; an elastic band attachment column 6 is respectively arranged at positions on both sides of the slit 5 and between the upper panel 3 and the lower panel 4; and two foot pedal middle shafts 7 moving back and forth in the arc-shaped slits 5 are arranged in the arc-shaped slits 5 of the upper panel 3 and the lower panel 4 and extend to the lower side of the lower panel 4; and foot pedals 8 are arranged at the bottoms of the foot pedal middle shafts 7, and the trainer steps the feet on the foot pedals 8 to train breaststroke leg actions more comfortably. The legs of the trainer can better fit to the foot pedals after prostration.

As shown in FIG. 5, rolling groove pulleys 9 matched with the upper panel 3 and the lower panel 4 are arranged on the foot pedal middle shafts 7, rolling groove pulleys 9 and the foot pedal middle shafts 7 are coaxial and are firmly fixed, the grooves (capable of clamping the lower panel 4) of the rolling groove pulleys 9 are matched with the arc-shaped slits 5 in widths and depths, the foot pedal middle shafts 7 are vertically fixed to the lower panel 4, and the foot pedal middle shafts 7 can move back and forth in the arc-shaped slits 5 under the action of external force by means of the fixing and rolling functions of the rolling groove pulleys 9.

As shown in FIG. 4, a plurality of stop blocks 10 and two movable strip steels 11 are arranged on both sides of a front end (close to one side of the inclined panel 2-2) of the arc-shaped slit 5 on the lower panel 4, the stop blocks 10 are matched with the strip steels 11 for use of adjusting the starting positions of the foot pedal middle shafts 7, the placement positions of the strip steels 11 in the stop blocks 10 are randomly changed, and the foot pedal middle shafts 7 are clamped on the outer side of the arc-shaped slits 5 so as to meet the use of trainers with different shoulder widths and body lengths.

Pores are formed in the fixed beam 13 and the two foot pedal middle shafts 7, the elastic band 1 is connected with the elastic band attachment column 6 through the fixed beam and the pores of the two foot pedal middle shafts, and when the foot pedal middle shafts 7 move back and forth in the arc-shaped slits 5, the elastic band 1 generates longitudinal and horizontal tension. The foregoing description is merely a preferred manner, when the fixed beam 13 and the two foot pedal middle shafts 7 are not provided with the pores through which the elastic band 1 penetrates, as long as the fixed beam 13 and the two foot pedal middle shafts 7 are rounded by the elastic band 1, the elastic band 1 can generate the longitudinal and horizontal tension.

The double-layer panel is supported by struts 12, but not limited to the struts 12.

A cross beam 14 connected with the fixed beam 13 is arranged on the double-layer panel for longitudinally reinforcing the fixed beam 13 so as to make the fixed beam 13 be more stable.

The prostrate platform 2 is supported by a telescopic bracket for adjusting the height of the prostrate platform 2.

When the trainer trains the breaststroke leg strength by using the embodiment, the specific steps are as follows:

(1) the positions of the strip steels 11 are adjusted, so that the distance between the two foot pedal middle shafts 7 is slightly larger than the shoulder widths of the trainer (standard technical requirements: when the action of drawing back the legs is ended, the inner sides of double knees of the trainer keep consistency with the outer edges of the shoulders of the trainer).

(2) The height of the prostrate platform 2 and the relative position with the double-layer panel are repeatedly adjusted to meet the requirements that the heels approach to the haunch when the trainer accomplishes the action of drawing back the legs.

(3) The trainer prostrates on the prostrate platform 2, grabs the fixed beam 13 on the front part of the prostrate platform 2 by double hands and performs the action of "drawing back, overturning, kicking and clamping) of breaststroke legs.

Figure 7:
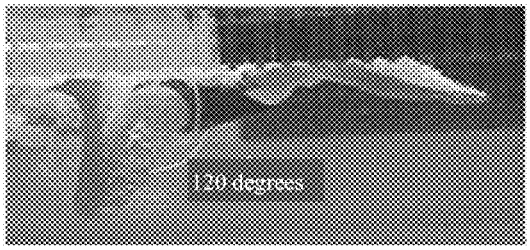
FIG. 7 and FIG. 8 are photos of leg postures of the trainer.
Figure 8:
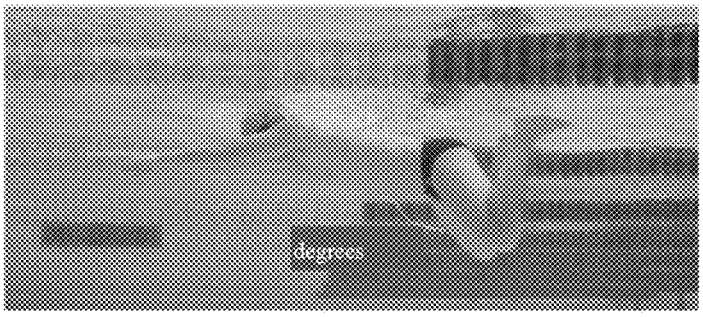

(4) As shown in FIG. 7 and FIG. 8, the trainer draws back the thighs, and the angles between the thighs and the trunk of the trainer are located are 120 degrees under the resistance of the 120-degree inclined panel.

(5) When the double feet are drawn back leaning against the inner sides of the foot pedals 8, and when the heels approach to the haunch, the trainer performs the actions of folding the tiptoes and overturning the feet.

Figure 9:
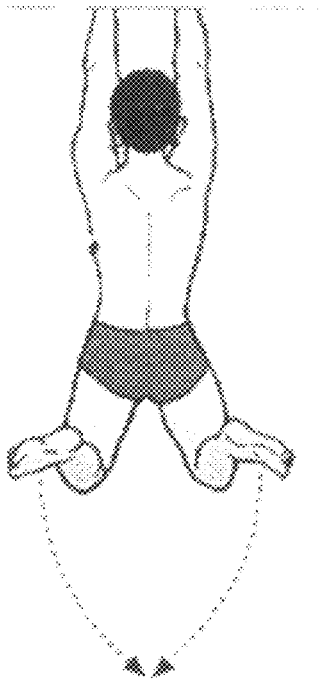
FIG. 9 and FIG. 10 are schematic diagrams of leg postures of the trainer.

(6) As shown in FIG. 9, after the feet are overturned, the inner sides of arches are aligned to the foot pedals 8.

Figure 10:
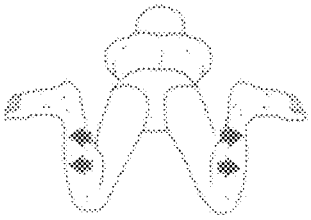

(7) As shown in FIG. 10, the actions of kicking and water clamping are carried out in directions where the inner sides of the arches are aligned to the shanks (at this time, the foot pedals 5 move backward along the slit).

(8) Under the tension of the longitudinal part of the elastic band 1, certain burden (the magnitude of the burden is changed according to the magnitude of the force of the trainer and the training burden requirements by increasing and decreasing the elastic bands 1) is brought to the muscle groups necessary for the backward "leg kicking" of the trainer, in order to develop special force.

(9) The trainer continues to kick the legs backward, when the two foot pedal middle shafts 7 are stepped to the last half stroke (when the "water clamping" action is carried out) of the arc-shaped slits 5 by the feet, the tension of the longitudinal elastic band 1 still exists, and the tension is "born by the panel" with the movement of the foot pedal middle shafts 7 toward the middle along the arc-shaped slits 5.

(10) In linkage with the above leg kicking action, the "water clamping" action is started, the two horizontal elastic bands 1 start to act to generate an outward counterforce so as to bring burden (the magnitude of the burden can also be changed according to the magnitude of the force of the trainer and the training burden requirements by increasing and decreasing the elastic bands 1) to the muscle groups necessary for the "water clamping" action of the trainer to train the force of the muscle groups necessary for the "water clamping" action.

(11) The water clamping action is accomplished (at this time, the two foot pedal middle shafts 7 are located at the most tail ends of the arc-shaped slits 5), the trainer clamps the double legs and slightly stretches the tiptoes toward the lower side, so that the double feet of the trainer separately move downward along the foot pedals 8, the vertical positions of the double feet have moved to the most bottoms (being separate from the foot pedals 8) of the foot pedals 8 when the foot stretching action is accomplished, and the foot pedals 8 are released.

(12) The trainer carries out the next action of "drawing back the legs", at this time, the "released" foot pedal middle shafts 7 will be drawn back (quickly returning to the front ends of the arc-shaped slits 5) under the action of the traction forces of the horizontal elastic band 1 and the longitudinal elastic band 1.

One flow is terminated, circulation is carried out, and convenient body training is carried out in accordance with the requirements of the number of groups, the number in each group, and the burden changes in each group required by a training plan.

Herein, the front ends of the arc-shaped slits 5 refer to the ends close to one side of the inclined panel 2-2.

Although the specific embodiments of the present invention have been described in combination with the drawings, it is not intended to limit the protection scope of the present invention, and it will be understood by those skilled in the art that various modifications or variations that may be made by those skilled in the art on the basis of the technical solutions of the present invention without creative effort are still within the protection scope of the present invention.

The invention claimed is:

1. A breaststroke leg strength training device, comprising a lower panel, and a prostrate platform that is connected with the lower panel through an elastic band and is located below one side of the lower panel;

a slit consistent with a breaststroke leg movement trajectory is formed in the lower panel, and an elastic band attachment column is respectively arranged at positions on both sides of the slit and on the lower panel;

two foot pedal middle shafts configured to move back and forth in the slit are arranged in the slit of the lower panel and extend to the lower side of the lower panel; and the elastic band is connected with the elastic band attachment columns through a fixed beam fixed to the prostrate platform and the two foot pedal middle shafts.

2. The breaststroke leg strength training device of claim 1, wherein an upper panel parallel to the lower panel and with a set distance from the lower panel is arranged on the lower panel, the upper panel is provided with a slit corresponding to the slit on the lower panel, and the upper parts of the two foot pedal middle shafts extend to the upper side of the upper panel.

3. The breaststroke leg strength training device of claim 1, wherein the prostrate platform is composed of a horizontal panel and an inclined panel, and the two planes form an angle of 120-130 degrees.

4. The breaststroke leg strength training device of claim 2, wherein rolling groove pulleys matched with the upper panel and the lower panel are arranged on the foot pedal middle shafts, the pulleys and the foot pedal middle shafts are coaxial and are firmly fixed, and the rolling groove pulleys vertically fix the foot pedal middle shafts between the upper panel and the lower panel.

5. The breaststroke leg strength training device of claim 1, wherein a plurality of stop blocks and movable strip steels are arranged on both sides of the slit on the lower panel, and the stop blocks are matched with the strip steels for use of adjusting the starting positions of the foot pedal middle shafts.

6. The breaststroke leg strength training device of claim 1, wherein foot pedals are arranged at the bottoms of the foot pedal middle shafts.

7. The breaststroke leg strength training device of claim 1, wherein the lower panel is supported by struts.

8. The breaststroke leg strength training device of claim 2, wherein a cross beam connected with the fixed beam is arranged on the upper panel.

9. The breaststroke leg strength training device of claim 1, wherein the prostrate platform is supported by a telescopic bracket.

10. The breaststroke leg strength training device of claim 2, wherein the distance between the upper panel and the lower panel is adjustable.

* * * * *